US007003805B1

(12) United States Patent
Woodfork, Jr.

(10) Patent No.: US 7,003,805 B1
(45) Date of Patent: Feb. 28, 2006

(54) ONE-SLEEVED RAINCOAT

(76) Inventor: Richard Woodfork, Jr., 5123 S. Kimbark Apt. 310, Chicago, IL (US) 60615

( * ) Notice: Subject to any disclaimer, the term of this patent is extended or adjusted under 35 U.S.C. 154(b) by 87 days.

(21) Appl. No.: 10/716,218

(22) Filed: Nov. 18, 2003

(51) Int. Cl.
*A41D 13/00* (2006.01)

(52) U.S. Cl. ..... 2/85; 2/93

(58) Field of Classification Search ..... 2/108, 2/88, 69, 93–96, 85, 83, 80
See application file for complete search history.

(56) References Cited

U.S. PATENT DOCUMENTS

| | | | | | |
|---|---|---|---|---|---|
| 272,537 | A | * | 2/1883 | Dowse | 2/88 |
| 1,239,995 | A | | 9/1917 | Whitside | |
| 1,387,937 | A | * | 8/1921 | Paull | 2/88 |
| 1,445,312 | A | * | 2/1923 | Handler | 2/88 |
| 1,854,476 | A | * | 4/1932 | Mason | 2/85 |
| 2,144,875 | A | * | 1/1939 | Forrest | 2/88 |
| 2,158,797 | A | | 5/1939 | Hill | |
| 2,345,059 | A | * | 3/1944 | Moats | 2/85 |
| 2,540,448 | A | | 2/1951 | Karow | |
| 2,898,599 | A | * | 8/1959 | Seckendorf | 2/88 |
| 2,932,037 | A | * | 4/1960 | Carroll | 2/88 |
| 3,258,781 | A | * | 7/1966 | Klein | 2/88 |
| 5,138,715 | A | * | 8/1992 | Baustin | 2/96 |
| 5,228,140 | A | * | 7/1993 | Baustin | 2/93 |

* cited by examiner

*Primary Examiner*—Gloria M. Hale
(74) *Attorney, Agent, or Firm*—Goldstein Law Offices, P.C.

(57) ABSTRACT

A raincoat capable of substantially protecting a body and a head of a user from becoming wet by falling rain, and additionally capable of protecting various personal belongings carried by the user from falling rain. The raincoat has a single sleeve through which one of the arms of the user selectively extends. The other arm and hand of the user, selectively used for carrying various personal belongings, selectively remain within and covered by the raincoat in order to prevent the personal belongings from becoming wet by falling rain, but may be extended as needed through a sealable arm opening positioned at a location on the raincoat opposed to the position from which the sleeve extends. The raincoat has a zippered hood compartment for selectively storing a hood. In use, the raincoat and attached hood substantially cover the user from the head down to the feet of the user, with the exception of the hands of the user.

15 Claims, 3 Drawing Sheets

ONE-SLEEVED RAINCOAT

BACKGROUND OF THE INVENTION

1. Field of the Invention

The invention generally relates to a raincoat, and in particular relates to a one-sleeved raincoat capable of protecting both the person of the user and items which are carried by the user from becoming wet by falling rain.

2. Description of the Related Art

A great variety of raincoats are available for protecting portions of a user's body from becoming wet by falling rain. However, the preponderance of these raincoats do not prevent purses, briefcases, bags, and other personal belongings carried by the user from becoming wet by falling rain. Accordingly, there is a need for a raincoat capable of shielding a body and head of a user from falling rain, and additionally capable of shielding purses, briefcases, bags, and other personal belongings carried by the user from rainfall.

A variety of protective garments have been devised for keeping both a body of a user and items carried by the user from becoming wet during rainfall. For example, U.S. Pat. No. 2,540,448 to Karow appears to show a protective garment for a mailman capable of covering a mailbag, thereby allowing it to remain dry during rainfall. Additionally, U.S. Pat. No. 2,158,797 to Hill appears to show a protective garment having one sleeve and allowing the user to carry and protect a package underneath. Furthermore, U.S. Pat. No. 1,239,995 to Whiteside appears to show a protective garment for use by a mailman, having a cape for selectively draping over a mailbag.

While these devices may be suitable for the particular purpose employed, or for general use, they would not be as suitable for the purposes of the present invention as disclosed hereafter.

SUMMARY OF THE INVENTION

It is an object of the invention to provide a raincoat capable of substantially preventing a body of a user and also the head of the user from becoming wet even during periods of very heavy rainfall. Accordingly, the raincoat is substantially full-length and covers the user from the neck down to the feet of the user, with the exception of the hands, and thereby substantially prevents the body of the user from becoming wet even during periods of very heavy rainfall. Additionally, the raincoat has a hood compartment for selectively storing a hood, for preventing the head of the user from becoming wet during periods of rainfall.

It is one of the primary objects of the invention to provide a raincoat capable of protecting purses, briefcases, bags, and other personal belongings carried by the user from becoming wet by falling rain. Accordingly, the raincoat features a one-sleeve design. One of the arms of the user selectively extends through the sleeve, while the other arm and hand of the user, and the personal belongings selectively carried within said other arm and hand, remain covered within and shielded by the raincoat, thereby protecting the personal belongings carried by the user within said other arm and hand from becoming wet by rainfall.

Further objects of the invention will become apparent in the detailed description of the invention which follows.

The invention is a raincoat capable of substantially protecting a body and a head of a user from becoming wet by falling rain, and additionally capable of protecting various personal belongings carried by the user from falling rain.

The raincoat has a single sleeve through which one of the arms of the user selectively extends. The other arm and hand of the user, selectively used for carrying various personal belongings, selectively remain within and covered by the raincoat in order to prevent the personal belongings from becoming wet by falling rain, but may be extended as needed through a sealable arm opening positioned at a location on the raincoat opposed to the position from which the sleeve extends. The raincoat has a zippered hood compartment for selectively storing a hood. In use, the raincoat and attached hood substantially cover the user from the head down to the feet of the user, with the exception of the hands of the user.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
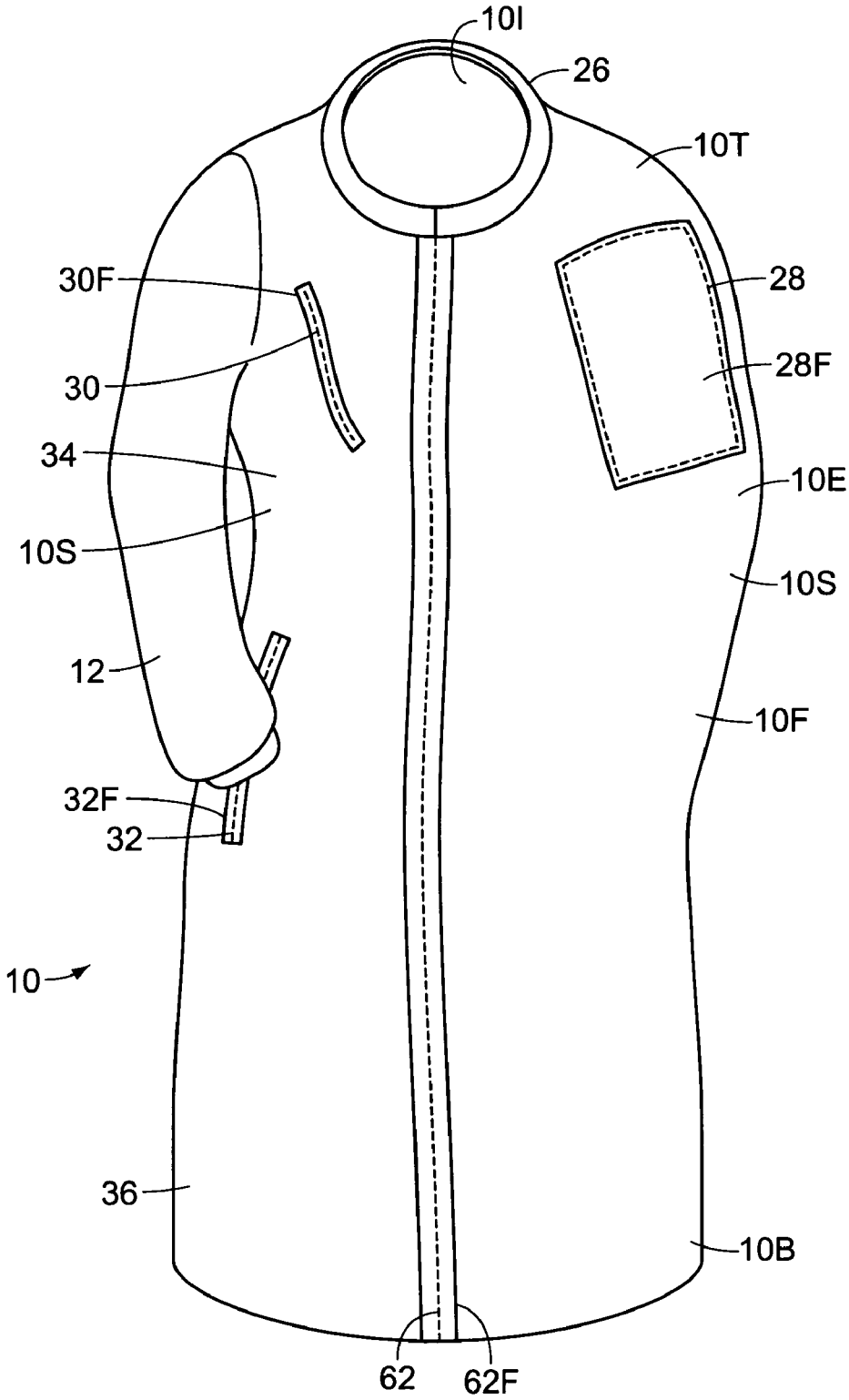
FIG. 1 is a perspective view of a raincoat, wherein a front of the raincoat is substantially visible.

FIG. 1 illustrates a raincoat 10, capable of substantially protecting the person of a user from falling rain, and additionally capable of protecting a variety of items carried by the user from falling rain. The raincoat 10 has a front 10F, a back 10R, a top 10T, a bottom 10B, two opposing lateral sides 10S, an internally oriented surface 10I which contacts the body of the user while the raincoat 10 is being worn by the user, and an externally oriented surface 10E. The externally oriented surface 10E of the raincoat 10 is substantially constructed from a waterproof vinyl or plastic material, lightweight enough to be comfortable, while still affording protection from the rain. The raincoat 10 has a chest portion 34 and a leg portion 36. The chest portion 34 completely covers and protects the torso of the user, and the leg portion 36 completely covers the legs of the user. In FIG. 1, the externally oriented surface 10E of the front 10F of the raincoat 10 is substantially visible.

The raincoat 10 has a single sleeve 12 extending from one of the lateral sides 10S of the raincoat 10 in proximity to the top 10T of the raincoat 10, through which one of the arms of the user selectively extends. In use, the sleeve 12 covers and protects said arm of the user from becoming wet by rainfall.

The raincoat 10 has a selectively sealable arm opening 28 positioned in proximity to the top 10T of the lateral side 10S of the raincoat 10 opposed to the lateral side 10S from which the sleeve 12 extends. The arm and hand of the user which are not extended through the sleeve 12 selectively remain within and are covered by the raincoat 10 in order to prevent items carried by said arm and hand from becoming wet by falling rain, but may be extended as needed from the arm opening 28.

The raincoat 10 will be provided in a right-handed version for a right-handed user, and a left-handed version for a left-handed user. The right-handed user will generally carry personal belongings using the right arm and hand. Accordingly, the right-handed version will have a single sleeve extending from the left lateral side of the raincoat 10, and the right hand and arm of the user which selectively carries the personal belongings of the user will be covered and shielded by the raincoat 10. Analogously, the left-handed version will have a single sleeve extending from the right lateral side of the raincoat 10, and the left hand and arm of the user which selectively carries the personal belongings of the user will be covered and shielded by the raincoat 10. The raincoat 10 is appropriately sized to accommodate a variety of different objects that the user may carry underneath the raincoat 10.

The external surface 10E of the raincoat 10 has two substantially vertically aligned openings, namely a chest pocket opening 30 and a pants pocket opening 32. The chest pocket opening 30 and the pants pocket opening 32 are positioned upon the same lateral side 10S of the raincoat 10 from which the sleeve 12 extends. The openings 30 and 32 allow the user to access the shirt pocket of an existing shirt or the pants pocket of an existing pair of pants worn by the user, respectively, without having to fully open the raincoat 10 and thereby expose the body of the user to rainfall. Each of the openings 30 and 32 has an associated flap, 30F and 32F, respectively, for selectively covering the openings 30 and 32, in order to prevent rain from getting inside the raincoat 10. Each of the flaps 30F and 32F has a strip of fastening material attached thereunto. Correspondingly, the externally oriented surface 10E of the raincoat 10 has strips of fastening material suitably positioned for selectively engaging the strips of fastening material on the flaps 30F and 32F, in order to create a waterproof seal when the flaps 30F and 32F are used to cover the openings 30 and 32, respectively. The fastening material is preferably the hook and loop fastener known by the trade name VELCRO. It is contemplated that the raincoat 10 will be provided with a chest pocket and a pant pocket on its internally oriented surface, in proximity to the chest pocket opening 30 and the pants pocket opening 32, respectively, for selectively holding a variety of items.

The front 10F of the raincoat 10 has a centrally located, vertically oriented zipper 62, extending fully from the top 10T to the bottom 10B of the raincoat 10, for allowing the user 40 to selectively close the raincoat 10 during use. The zipper 62 has a waterproof zipper flap 62F which selectively overlays the zipper 62, thereby ensuring that water will not enter the raincoat 10 through the zipper 62. The zipper flap 62 has a strip of fastening material running along a substantial portion of its length. Correspondingly, the raincoat 10 has a strip of fastening material in proximity to the zipper flap 62 for selectively engaging the fastening material on the zipper flap 62F after the zipper flap 62 has been overlaid over the zipper 62. The fastening material is preferably the hook and loop fastener known by the trade name VELCRO.

The raincoat 10 has a substantially circular collar 26 which encircles the neck of the user while the raincoat 10 is being worn, after the zipper 62 has been closed. The head and neck of the user extend through the collar 26 while the raincoat 10 is being worn.

Figure 2:
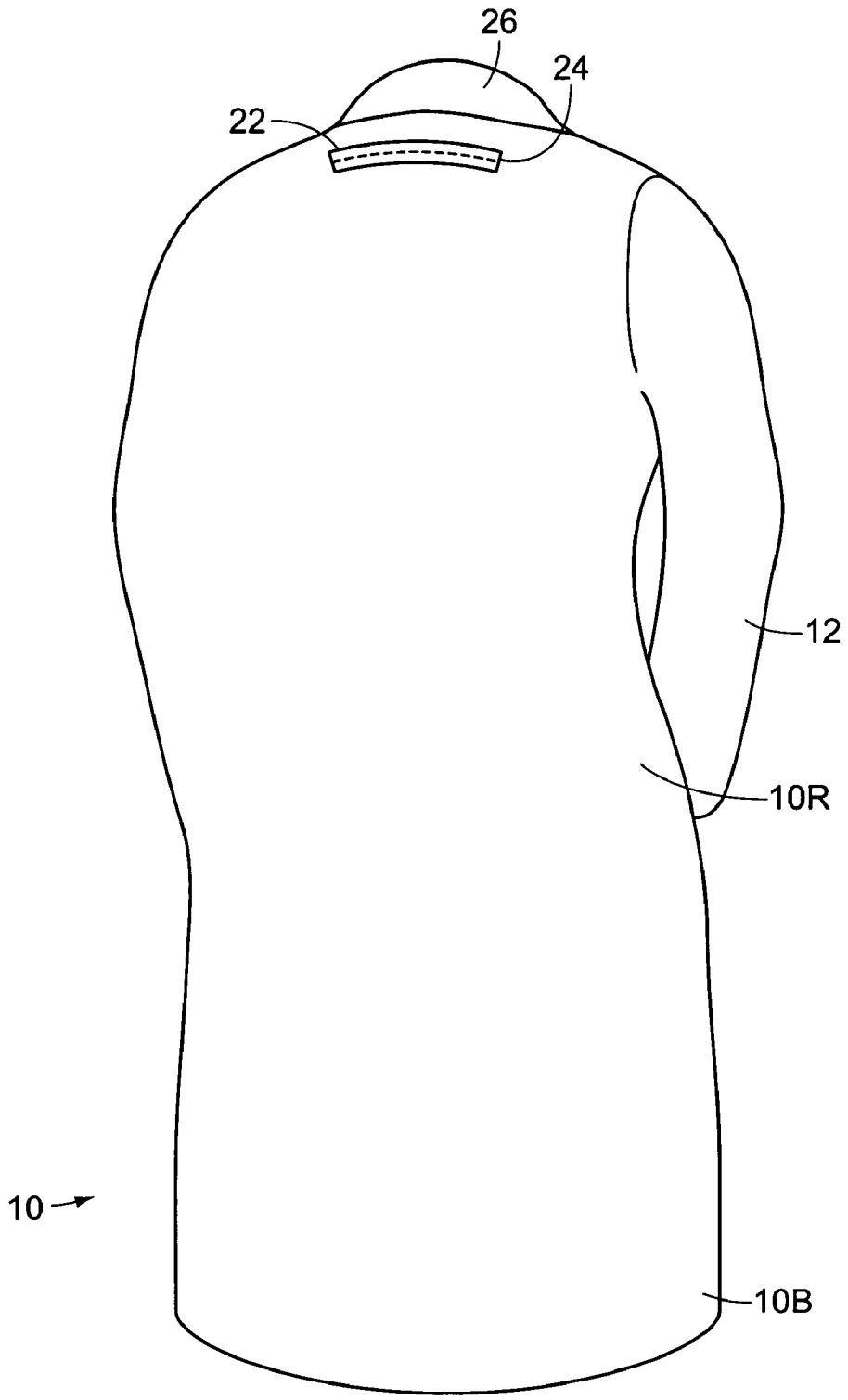
FIG. 2 is a perspective view of the raincoat, wherein a back of the raincoat is substantially visible.

FIG. 2 illustrates a view of the raincoat 10 wherein the back 10R of the raincoat 10 is substantially visible. The back 10R of the raincoat 10 has a hood compartment 24 in proximity to the collar 26 for selectively storing a hood 20. The hood compartment 24 has a zipper 22 for selectively closing the hood compartment 24 when the hood 20 is being stored therein.

Figure 3:
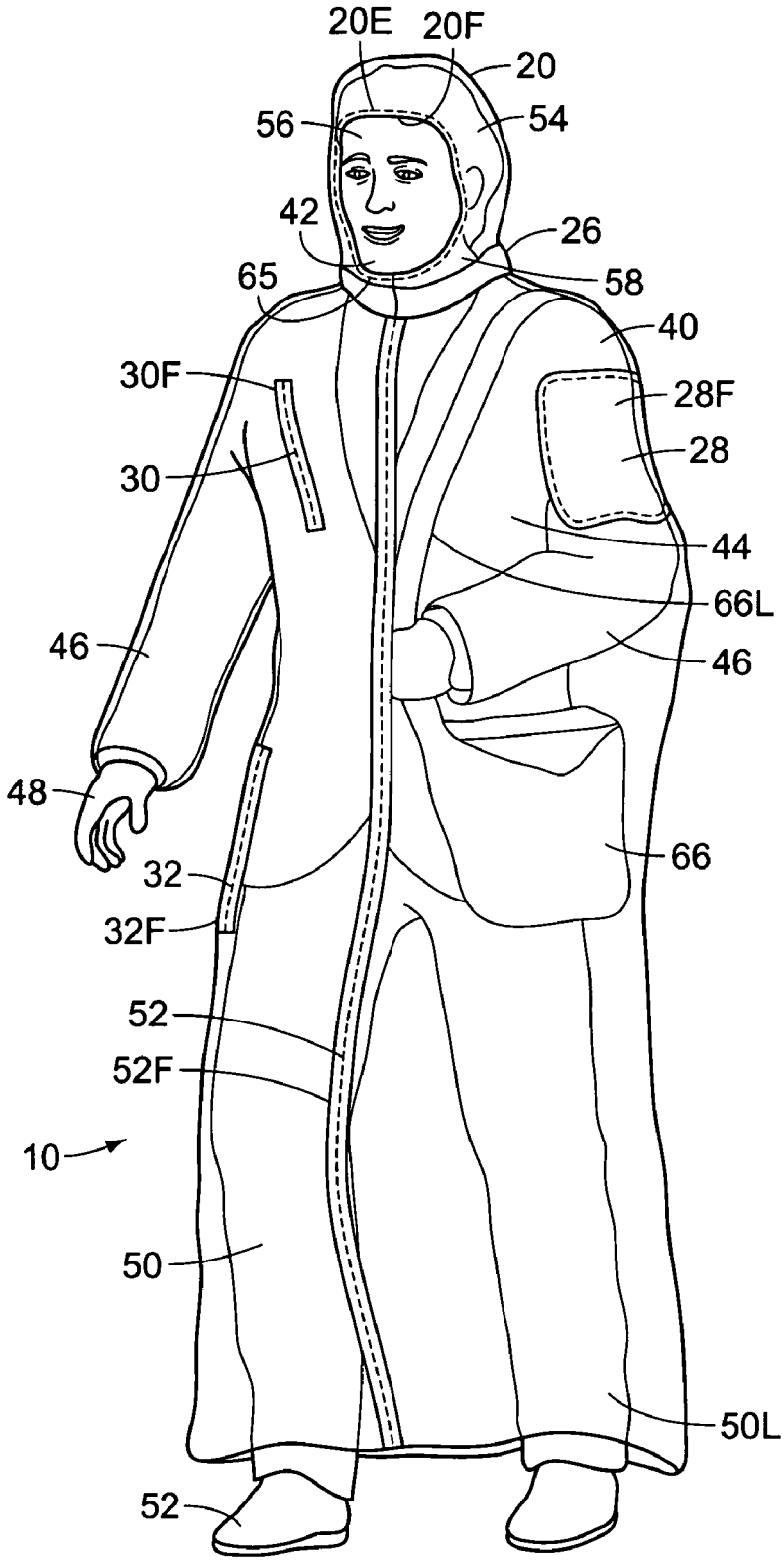
FIG. 3 is a perspective view of the raincoat being worn by a user carrying a briefcase having an associated shoulder strap.

FIG. 3 illustrates a raincoat 10 being worn by a user 40 having a head 54 having a face 56 having a chin 42, a neck 58, a torso 44, two arms 46 each having a hand 48, and two legs 50 each having a lower part 50L and each having a foot 52. The user 40 is carrying a briefcase 66 having a shoulder strap 66L. The raincoat 10 is substantially full-length, and covers the user 40 from the neck 58 to the lower part 50L of the legs 50 of the user 40, with the exception of the hands 48 and the feet 52 of the user 40. One of the arms 46 of the user 40 extends through the sleeve 12. The other arm 46 and hand 48 are being used to carry the briefcase 66 by its associated shoulder strap 66L, and said arm 46 and hand 48, and the briefcase 66, are completely covered by the raincoat 10. The hood 20 has been selectively extended from the hood compartment 24, and is being used to cover the head 54 of the user 40. The hood 20 has a substantially oval face opening 20F through which the face 56 of the user 40 protrudes during use. The face opening 20F has an elastic strip 20E around its perimeter, thereby ensuring a "tight fit" so that the head 54 of the user 40 remains dry even in very heavy rain conditions. The hood 20 is constructed from vinyl or plastic. The hood 20 is equipped with a chinstrap 65 for selectively firmly anchoring the hood 20 to the chin 42 and head 54 of the user 40. The hood 20 selectively covers the back and top of the head 54 of the user 40, and also substantially covers the neck 58 of the user 40, thereby protecting the neck 58 and head 54 of the user 40 from becoming wet by falling rain.

In use, the raincoat 10 is worn by the user 40 over the existing clothes of the user 40. The user 40 chooses a right-handed or left-handed version of the raincoat 10, depending on whether the user is right-handed or left-handed, respectively. The user 40 selects a raincoat 10 having a size and girth capable of accommodating both the body of the user 40 and the items that the user 40 expects to carry underneath the raincoat 10. For example, a mailman would choose a raincoat 10 having a size which is capable of fully covering both the body of the mailman and a potentially bulky mailbag carried by the mailman. The user 40 extends one of the arms 46 of the user 40 through the sleeve 12, and then substantially covers the remaining part of the body of the user 40 with the raincoat 10. The user 40 closes the centrally located zipper 62. The user 40 overlays the zipper flap 62 over the zipper 62, and secures the zipper flap 62 by mating the fastening material on the zipper 62 with the corresponding strip of fastening material extending along the length of the raincoat 10 in proximity to the zipper 62. The user 40 closes the chest pocket opening 30, the pants pocket opening 32, and the arm opening 28, with the flaps 30F, 32F, and 28F provided for this purpose, and secures said flaps by mating the fastening material of the flaps with the corresponding strips of fastening material located on the externally oriented surface 10E of the raincoat 10. The user 40 selectively extends the hood 20 of the raincoat 10 over the head 54 of the user 40 and secures the chinstrap 65 underneath the chin 42 of the user 40. In the event that the user 40 needs to retrieve an item carried by the arm 46 and hand 48 of the user 40 which are shielded underneath the raincoat 10, the user 40 disengages the fastening material of the flap 28F from the underlying fastening material on the raincoat 10 with the hand 48 of the arm 46 which extends through the sleeve 12, extends said arm 46 through the arm opening 28, and grasps and retrieves the item with the hand 48 of said arm 46. After donning the raincoat 10, the user 40 may confidently walk outdoors during even heavy rainfall without fearing that the user 40 or the items carried by the user 40 will become wet by rainfall.

In conclusion, herein is presented a raincoat capable of shielding a substantial portion of a human body from rainfall, and also capable of shielding items carried by the user from rainfall. The invention is illustrated by example in the drawing figures, and throughout the written description. It should be understood that numerous variations are possible, while adhering to the inventive concept. Such variations are contemplated as being a part of the present invention.

What is claimed is:

1. A raincoat for preventing a user from becoming wet by rainfall, and also for preventing at least one item which is being carried by the user from becoming wet by rainfall, said user having a body having a head having a back and a top of the head, having a face having a chin, a neck, a torso, two arms each having a hand, and two legs each having a foot, said raincoat to be selectively worn over the existing clothing of the user, comprising:

a front, a back, a top, a bottom, two opposing lateral sides, an internally oriented surface which contacts the body of the user while the raincoat is being worn by the user, an externally oriented surface substantially constructed from a waterproof material, the externally oriented surface of the raincoat has a chest pocket opening and a pants pocket opening, for allowing the user to access the existing clothing of the user without having to fully open the raincoat and thereby expose the body of the user to rainfall, a chest portion for completely shielding the torso of the user from rainfall, and a leg portion for completely shielding the legs of the user from rainfall; and a single sleeve extending from one of the lateral sides of the raincoat in proximity to the top of the raincoat, through which one of the arms of the user selectively extends, said sleeve for selectively preventing said arm of the user from becoming wet by rainfall, and wherein the arm which is not extended through the sleeve remains within and is covered by the raincoat, thereby shielding said arm and the hand attached to said arm from rainfall, and thereby allowing the user to carry the at least one item within said hand and thereby also prevent the at least one item from becoming wet from rainfall; and a selectively sealable arm opening positioned in proximity to the top of the lateral side of the raincoat opposed to the lateral side from which the sleeve extends, said arm opening for enabling the user to retrieve the at least one item carried by the arm and the hand of the user which do not extend through the sleeve by using the hand of the arm which does extend through the sleeve.

2. The raincoat as recited in claim 1, wherein the back of the raincoat has a hood compartment, in proximity to the collar, having a hood selectively stored therein, the hood for selectively covering the back and top of the head of the user, and also for substantially covering the neck of the user, thereby protecting the neck and head of the user from becoming wet by rainfall.

3. The raincoat as recited in claim 2, wherein the front of the raincoat has a substantially centrally located, vertically oriented zipper, extending from the top to the bottom of the raincoat, for allowing the user to selectively close the raincoat during use.

4. The raincoat as recited in claim 3, wherein the chest pocket opening and the pants pocket opening each have an associated flap for selectively covering said openings, for preventing rainfall from entering into the raincoat.

5. The raincoat as recited in claim 4, wherein the zipper has an associated zipper flap which selectively overlays the zipper, thereby preventing rainfall from entering the raincoat through the zipper.

6. The raincoat as recited in claim 5, wherein the flaps associated with the chest pocket opening and the pants pocket opening each have a strip of fastening material attached thereunto, and wherein the externally oriented surface of the raincoat has corresponding strips of fastening material suitably positioned for selectively engaging the strips of fastening material on said flaps, in order to create a waterproof seal when said flaps are used to cover the chest pocket opening and the pants pocket opening.

7. The raincoat as recited in claim 6, wherein the zipper flap has a strip of fastening material running along a portion of its length, and wherein the raincoat has a strip of fastening material in proximity to the zipper flap for selectively engaging the fastening material on the zipper flap after the zipper flap has been overlaid upon the zipper.

8. The raincoat as recited in claim 7, wherein the hood compartment has a zipper for selectively closing the hood compartment when the hood is being stored therein.

9. The raincoat as recited in claim 8, wherein the raincoat is substantially full-length, and covers the user substantially from the neck to the feet of the user, with the exception of the hands of the user.

10. The raincoat as recited in claim 9, wherein the hood has a substantially oval face opening through which the face of the user protrudes during use, wherein the face opening has an elastic strip around its perimeter, thereby ensuring that the head of the user remains dry even during very heavy rainfall.

11. The raincoat as recited in claim 10, wherein the hood is equipped with a chinstrap for selectively firmly anchoring the hood to the chin and head of the user.

12. The raincoat as recited in claim 11, further comprising a substantially circular collar which substantially encircles the neck of the user while the raincoat is being worn.

13. The raincoat as recited in claim 12, wherein the externally oriented surface of the raincoat is substantially constructed from a vinyl material.

14. The raincoat as recited in claim 12, wherein the externally oriented surface of the raincoat is substantially constructed from a plastic material.

15. A method of protecting both the person of a user and at least one item carried within a hand of the user from becoming wet by rainfall, said user having a body having a head having a face having a chin, a neck, a torso, two arms each having a hand, and two legs each having a lower part and each having a foot, said user carrying at least one item within one of the hands of the user, said method utilizing a raincoat having a front, a back, a top, a bottom, two opposing lateral sides, an externally oriented surface, and a single sleeve, extending from one of the lateral sides in proximity to the top of the raincoat, the raincoat further having an arm opening positioned in proximity to the top of the lateral side of the raincoat opposed to the lateral side from which the sleeve extends, a chest pocket opening, and a pants pocket opening, wherein the chest pocket opening and the pants pocket opening each have an associated flap having a strip of fastening material attached thereunto, and wherein the externally oriented surface of the raincoat has corresponding strips of fastening material suitably positioned for selectively engaging the strips of fastening material on said flaps, wherein the front of the raincoat has a zipper having an associated zipper flap having a strip of fastening material, wherein the raincoat has a strip of fastening material in proximity to the zipper flap, wherein the back of the raincoat has a hood compartment having a hood having a chinstrap selectively stored therein, said method comprising the steps of:

extending one of the arms of the user through the sleeve;

covering the body of the user from the neck substantially to the feet with the raincoat;

closing the zipper on the front of the raincoat in order to completely cover and protect the torso and legs of the user from falling rain;

overlaying the zipper flap over the zipper;

securing the zipper flap by mating the fastening material on the zipper flap with the corresponding strip of fastening material on the raincoat;

closing the chest pocket opening, the pants pocket opening, and the arm opening with their associated flaps;

securing said flaps by mating the fastening material of the flaps with the corresponding strips of fastening material located on the raincoat;

extending the hood of the raincoat over the head of the user in order to protect the head and also the neck of the user from falling rain;

securing the chinstrap underneath the chin of the user;

carrying the at least one item within the hand and arm of the user which does not extend through the sleeve, while shielding the at least one item by the raincoat;

retrieving an item carried by the arm and hand of the user which are shielded underneath the raincoat, by disengaging the fastening material of the flap associated with the arm opening from the underlying strip of fastening material on the raincoat, by extending the arm which is covered by the sleeve through the arm opening, and by using the hand attached to said arm to grasp and retrieve the at least one item; and walking during periods of rain without exposing either the body or the at least one item held by the user to rainfall.

* * * * *